US008939139B2

(12) United States Patent
Sims et al.

(10) Patent No.: US 8,939,139 B2
(45) Date of Patent: Jan. 27, 2015

(54) ARCHERY BOW ACCESSORIES

(76) Inventors: Steven C. Sims, Shelton, WA (US); Gary Sims, Shelton, WA (US)

( * ) Notice: Subject to any disclaimer, the term of this patent is extended or adjusted under 35 U.S.C. 154(b) by 0 days.

(21) Appl. No.: 12/456,506

(22) Filed: Jun. 17, 2009

(65) Prior Publication Data

US 2010/0319670 A1 Dec. 23, 2010

(51) Int. Cl.
*F41B 5/20* (2006.01)
*F41B 5/14* (2006.01)

(52) U.S. Cl.
CPC ..... *F41B 5/1426* (2013.01)
USPC ..... 124/89

(58) Field of Classification Search
USPC ..... 124/88–90; D22/107
See application file for complete search history.

(56) References Cited

U.S. PATENT DOCUMENTS

| | | | | |
|---|---|---|---|---|
| 4,245,612 | A * | 1/1981 | Finlay | 124/89 |
| 6,298,842 | B1 * | 10/2001 | Sims | 124/89 |
| 6,588,414 | B2 * | 7/2003 | McMillan, III | 124/89 |
| 6,718,964 | B1 * | 4/2004 | Graf | 124/89 |
| D514,654 | S * | 2/2006 | Sims | D22/107 |
| 2003/0226556 | A1 * | 12/2003 | Leven | 124/89 |

* cited by examiner

*Primary Examiner* — Gene Kim
*Assistant Examiner* — Amir Klayman
(74) *Attorney, Agent, or Firm* — Wells St. John, PS

(57) ABSTRACT

B/D archery bow accessories which have an elastomeric vibration dampening component mounted on an elongated, rigid support. The elastomeric component has a set of integral vibration dampening elements such as ribs. The vibration dampening elements have irregular profile configurations which make these elements capable of dampening with high efficiency the sets of vibrational frequencies generated: (a) when an arrow is shot, and (b) during and after the ensuing lock-up. Vibration dampening efficiency may be promoted by making the elastomeric component from a material of the most optimal hardness that is practical and by employing end pieces at opposite ends of the elastomeric component.

5 Claims, 3 Drawing Sheets

ARCHERY BOW ACCESSORIES

TECHNICAL FIELD OF THE INVENTION

The present invention relates to novel, improved accessories for archery bows and, more particularly, to novel improved accessories for balancing a bow and dampening vibrations: (a) when an arrow is shot from the bow, and (b) during and after the subsequent lock-up.

DEFINITIONS

Vibration: includes: (a) shocks and vibrations with frequencies: (1) in the audible range, and (2) higher and lower than those in the audible range, and (b) shocks and vibrations with the different amplitudes present in any particular frequency spectrum.

B/D Accessory: an archery bow accessory with the capabilities of balancing a bow and dampening vibrations generated when an arrow is shot from the bow.

Lock-up: that period extending from the time the bow string is released to shoot an arrow to the time that the arrow leaves the bow.

BACKGROUND OF THE INVENTION

When an arrow is shot from an archery bow, from 10 to 25% of the energy generated when the bow string is released remains in the bow. This energy can adversely affect the accuracy of the shot. Also, the residual energy generates significant vibration. Transmission of the vibration to the shooter's hand causes discomfort and can cause the shooter to flinch, reducing the accuracy of, or entirely spoiling, the shot. The sound of the shot can also elicit an unwanted reaction from the shooter and, if the shooter is a hunter, can frighten the intended target, causing it to suddenly move, again spoiling the shot. Numerous factors and energies contribute to the vibration and to the feel of the bow when an arrow is shot. Representative of these factors are: string oscillation, limb spring, riser flex, etc.

Stabilizers have for a long time been employed to reduce an adverse influence on the balance of a bow when an arrow is shot from the bow and, after the shot, during the lock-up time; i.e., the time while the arrow is still in the bow. Balance is extremely important; the more balanced the bow, the easier it is to stay on target while aiming the bow.

Typically, these stabilizers are long, rodlike or comparable devices which extend well in front of the bow and are mounted to the riser of a compound bow or comparable component of a recurve or other bow to reduce movement of the bow when the arrow is shot.

Later developed bow stabilizers may be mounted to the bow with the additional goal of reducing vibration and improving the feel of the bow by aggressive attenuation of energy. One type of bow stabilizer with vibration reducing capabilities employs an elastomeric component to rapidly reduce vibration energies by visco-elastic resistance. A superior, commercially available bow stabilizer of this type is illustrated in FIG. 1 and identified by reference character 20.

Stabilizer 20 has a series 22 of integral, annular ribs 24*a* . . . 24*g* with uniformly circular peripheries. Ribs 24*a* . . . 24*g* are separated by integral stems. A representative stem is identified by reference character 26. Ribs 24*a* . . . *g* are located between an integral, stemmed, mushroom-shaped end member 30 and an integral, frustoconical end member 32. The vibrational are complex Ribs 24*a* . . . 24*g* effectively reduce these motions because they have multiple degrees of freedom which allow them to move universally; i.e., in any direction in a 360° (spherical) pattern.

Another, heretofore proposed bow stabilizer with an elastomeric, "energy dispersion" component is shown in FIGS. 4, 7, and 8 of U.S. Pat. No. 6,802,307 to Levin. The Levin devices are unnecessarily complex and less efficient than the type of bow stabilizer illustrated in FIG. 1 and, to the extent that they do appreciably dampen vibrations, do so in only a very narrow frequency range. The elastomeric component of a Levin device is a rubber knuckle which houses a stabilizer weight. It is the oscillation of this weight, not the visco-elastic resistance of integral, elastomeric stabilizer elements which is relied upon to reduce vibration when an arrow is shot from a bow equipped with a Levin device.

Yet another prior art stabilizer with an elastomeric component, though one of significantly different construction, is the NAP Blackjack illustrated at: http://www.cabelas.com/prod-1/0039028417438a.shtml and http://www.keystonecountrystore.com/NAP_Stabilizer.html. This complicated device is said to reduce recoil and dampen sound when an arrow is shot from a bow due to the provision of "energy fins" on a sleeve.

SUMMARY OF THE INVENTION

Superficially, the novel, improved bow B/D accessories disclosed herein resemble prior art stabilizer 20 in that they have an elastomeric component which includes a set of axially aligned, annual ribs separated by integral stems and embraced by integral end pieces However, the B/D accessories of the present invention are, significantly more effective in reducing vibration than the FIG. 1 type stabilizer 20, and they work effectively with a significantly wider variety of bows than prior art, stabilizer type devices and are as effective as those devices as far as the balancing of a bow is concerned. The increase in efficiency is attributable in large part to a rib configuration which has a margin-defining edge with an irregular profile or, stated otherwise, a margin-defining edge which has a variable height relative to the axial centerline of the elastomeric component.

The rib configurations of the present invention as described in the preceding paragraph produce ribs having a relatively stiff inner segment which efficiently dampens vibrations (including shock and sound) that have a high frequency and a more flexible outer segment which efficiently dampens vibrations which lower frequencies.

In these inner and outer regions or segments of the rib, vibrations are dampened by oscillation, fore-and-aft and side-to-side bending, elongation, twisting, contraction, rippling, flopping, and other distortions of the elastomeric material. These motions of the elastomeric B/D accessory components, as a class, are identified herein by the judicially approved and construed term "wiggle and jiggle". The rib configurations of the present invention described above promote, to an important extent, vibration dampening wiggling and jiggling of the elastomeric material because they have multiple operating modes. Specifically, each rib segment of different size and/or shape effectively dampens a particular set of vibrational frequencies or a number of such sets. And the segments are configured to most effectively dampen different sets of vibrational frequencies such that all of the frequencies in a target spectrum are efficiently dampened.

The feature, advantages, and objects of the present invention will be apparent to the reader from the foregoing, the claims, and the ensuing detailed description of the invention taken in conjunction with the accompanying drawing.

DETAILED DESCRIPTION OF THE INVENTION

Figure 2:
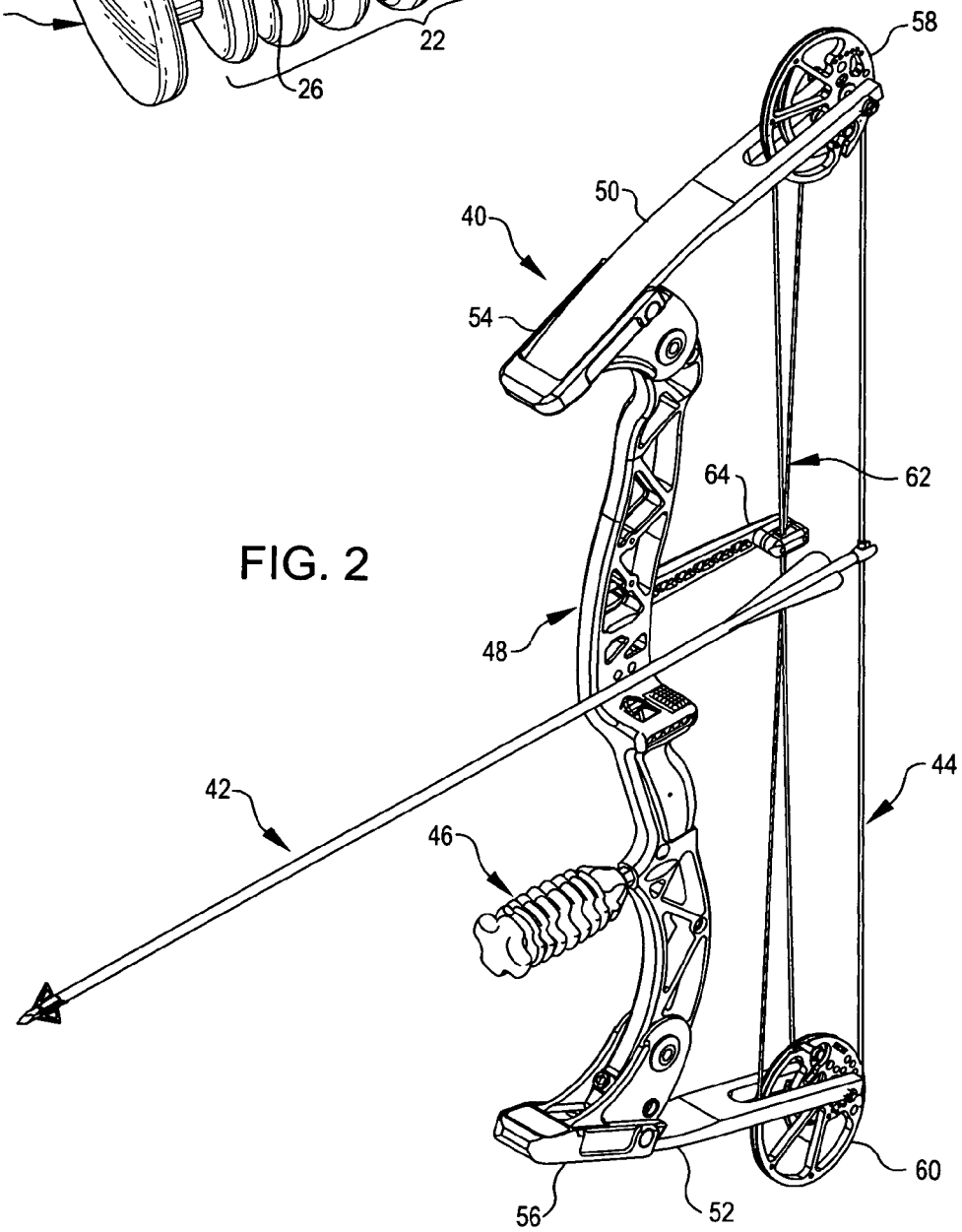
FIG. 2 is a perspective view of an archery bow equipped with an archery bow B/D accessory which embodies and is constructed in accord with the principles of the present invention.

Referring now to the drawings, FIG. 2 depicts a compound archery bow 40 of the character disclosed in previously filed application Ser. No. 12/287,506, which has a filing date of 9 Oct. 2008 and is hereby, in its entirety, incorporated in this specification. An arrow 42 is flocked to bow string 44, and the bow is equipped with a B/D accessory 46 embodying, and constructed in accord with, the principles of the present invention.

Bow 40 has a riser 48 and upper and lower limbs 50 and 52 mounted to riser 48 in articulated limb pockets 54 and 56. Rotatable, axle-mounted cams 58 and 60 are mounted to the tips of upper and lower limbs 50 and 52. Buss/control cables collectively identified by reference character 62 and the aforementioned bow string 44 are strung between upper and lower cams 58 and 60 with the buss/control cables 62 being trained through a riser-mounted cable guide 64.

Details of the bow 40 just described appear in the above-cited '506 application.

Referring still to FIG. 2, but also to FIGS. 3-7, B/D bow accessory 46 has an axial line of symmetry 65 (see FIG. 5) and an elastomeric component 66 mounted on, and surrounding, an elongated, rigid member 68. B/D accessory 46 is mounted to the riser 48 of bow 40 by an externally threaded, integral end segment 70 of rigid component 68 (see FIG. 4). This segment is threaded into a complementary, internally threaded hole 72 in the front side of riser 48. Flats on rigid member 68 adjacent threaded end segment 70 accommodate a wrench if one is employed to tighten the rigid member 68 after its end segment 70 is threaded into riser hole 72. A representative one of these flats is identified by reference character 74 in FIG. 3.

The elastomeric component 66 of representative B/D accessory 46 has a set 76 of integral, annular; vibration dampening elements. In accessory 46, these elements are ribs 78. Six of these ribs are divided into two subsets 80 and 82 disposed in mirror image-relationship on opposite sides of a central rib 78*d*. Subset 80 contains ribs 78*a*-78*c*, and subset 82 contains ribs 78*e*-78*g*. From outer to inner end, the ribs in each set increase in thickness with ribs 78*b* and 78*f* being thicker than ribs 78*a* and 78*g* and ribs 78*c* and 78*e* being thicker than the adjacent ribs 78*b* and 78*f*. The central rib 78*d* is thicker than the adjacent ribs 78*c* and 78*e* in rib subsets 80 and 82.

Each of the ribs 78*a*-78*g* is separated from its neighbor by an annular, associated and integral, longitudinally-extending stem. One of these stems is shown most clearly in FIG. 7 and identified by reference character 84. A like stem 86 separates the seventh annular rib 78*g* from an integral, frustoconical, end component 87 of elastomeric B/D accessory component 66. The end number 87 of B/D accessory 46 and each of the seven head/stem units such as 78*a*/84 function, in this respect, in a manner akin to that of the damping devices disclosed in the above-cited '046 patent At the opposite end of the elastomeric component 66 of B/D bow accessory 46 is a second, also integral, mushroom-shaped end member 88. This component has an annular head 90 and a longitudinally oriented stem 92 which extends from the head to annular rib 78*a*.

End members 87 and 88 and the combination of ribs 78*a*-78*g* and integral stems such as that identified by reference character 84 (FIG. 7) rapidly, and efficiently, reduce vibration energies via visco-elastic resistance when arrow 42 is shot from bow 40. The effect of frustoconical end member 87, mushroom-shaped end member 88, and each of the rib/stem units such as the one made up of rib 78*a* and stem 84 is cumulative, resulting in B/D device 46 being appreciably more effective than a dampening device such as one of those dampening devices shown in FIGS. 2 and 7 of the '046 patent, for example.

An important feature of B/D bow accessory 46 is that each of the seven annular ribs 78*a*-78*g* has a margin-defining edge with an irregular profile which divides the rib into regions with different sizes and/or shapes. In this instance the profile has a variable height relative to the axial centerline of the accessory component 66 as is preferred in the practice of the present invention. Specifically, each of the ribs 78*a*-78*g* of the representative B/D accessory 46 illustrated in FIGS. 2-7 has a cruciform external configuration defined by cutouts such as those identified by reference characters 94*a*-94*d* spaced around the periphery of the rib (see FIGS. 3 and 6). In representative B/D accessory 46, these cutouts are scallops, but this particular configuration is not essential; and cutouts with other configurations and/or spaced unequally around the rib may prove superior in other embodiments of the invention.

Figure 6:
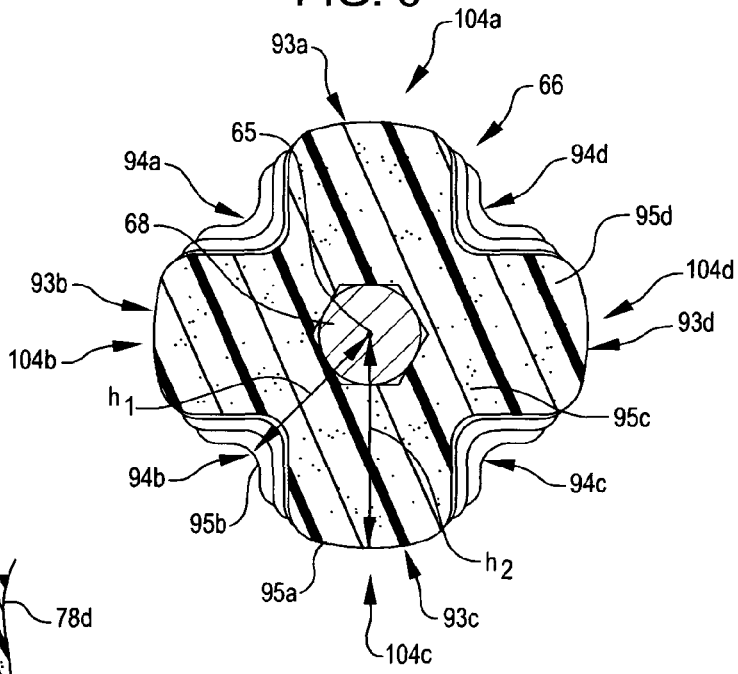
FIG. 6 is an enlarged scale transverse section through the B/D accessory, taken substantially along line 6-6 of FIG. 5.
Figure 7:
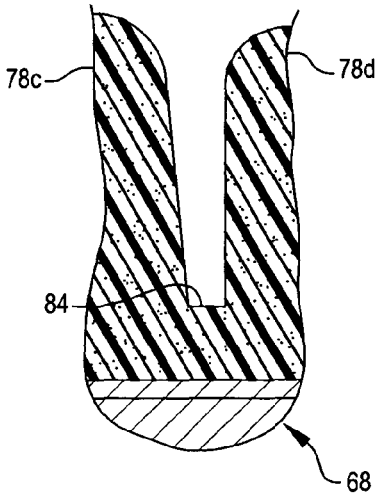
FIG. 7 is a fragment of FIG. 5 drawn to an enlarged scale to better show representative rib and stem elements of an elastomeric component of the FIG. 1 B/D accessory.

The scallops, which extend only part way to the rib-associated stems such as 84, provide in each rib protrusions 93*a*-93*d* with convex external surfaces such as the one identified by reference character 95*a* in FIG. 6. The scallops d 94*a*-94*d* have concave exterior surfaces, one of these being identified by reference character 95*b*.

Thus, each of the ribs 78*a*-78*g* of B/D accessory 46 meets the requirement that it have an irregular profile and, further, satisfies the strong preference for a rib which has a variable height relative to the axial centerline of the elastomeric accessory component 66. In particular, each of the ribs 78*a*-78*g* varies in height from a minimum height $h_1$ relative to the axial centerline 65 of the B/D accessory 46 to a maximum height $h_2$ relative to that centerline (see FIG. 6). As discussed above this produces an inner rib region 95*c* and outer rib regions such as 95*d* (FIG. 6) which are relatively stiff and flexible, respectively; which have different sizes and shapes; and which therefore provide optimal, multimode dampening of high frequency and low frequency vibrations.

While equiangular spacing of the scallops is employed in representative B/D accessory 46, and while all of the scallops are of the same size and shape as are the ribs (except for thickness), this is not a requirement of the invention. Variations such as ribs of different sizes and shapes and/or scallops which likewise vary in size and/or shape and/or are spaced at other than equiangular distances may equally well be employed in other embodiments of the present invention. Also, as stated above, cutouts of any other appropriate shape may be employed instead of scallops.

Figure 3:
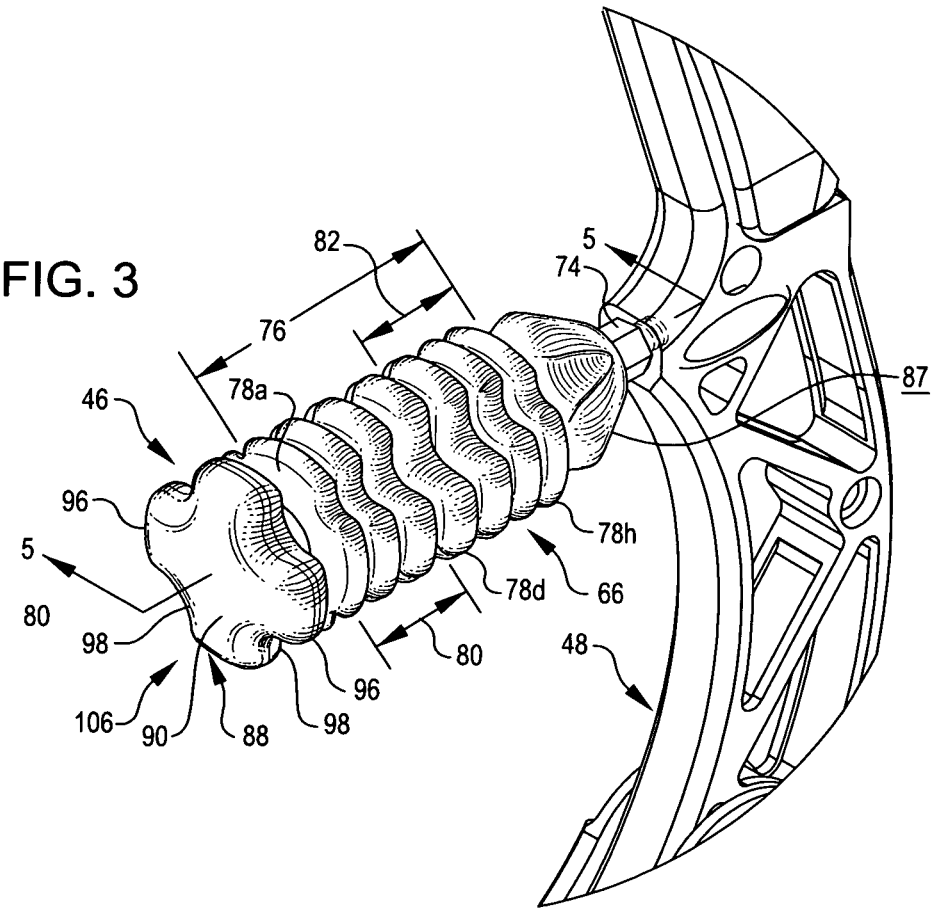
FIG. 3 an enlarged scale fragment of FIG. 2.
Figure 4:
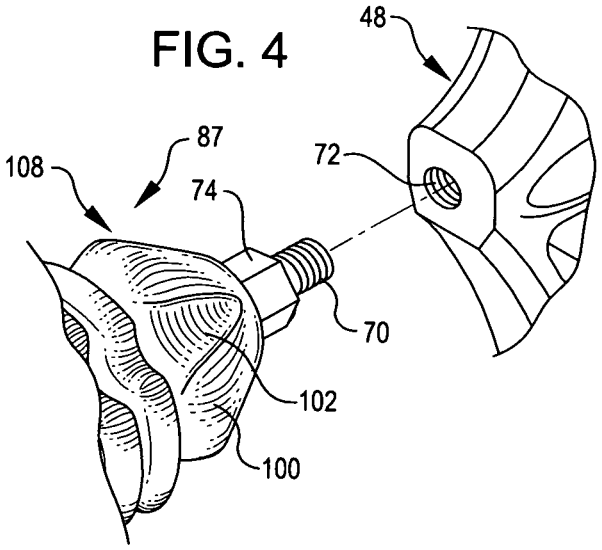
FIG. 4 is a fragmentary exploded view showing how the B/D accessory is attached to the bow.
Figure 5:
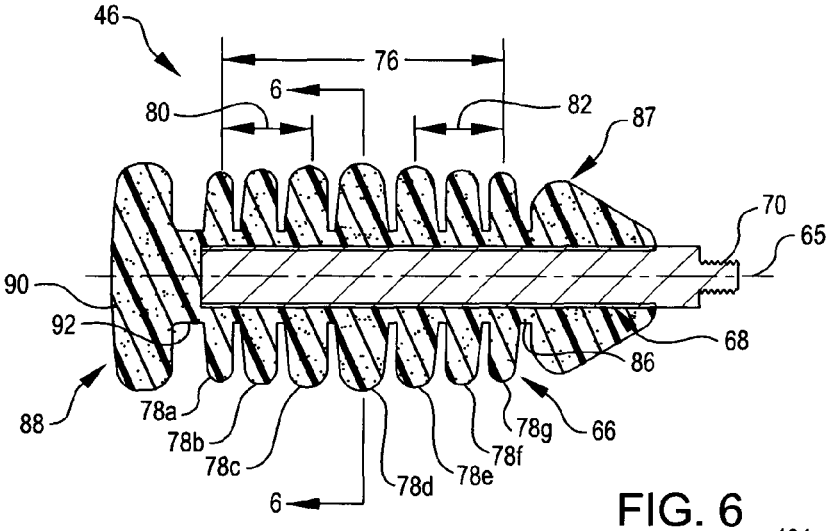
FIG. 5 is a longitudinal section through the B/D accessory, taken substantially along line 5-5 of FIG. 3.

As shown FIG. 3, the head 90 of representative elastomeric component end member 88 and the frustoconical end member 87 of that component also have symmetric, cruciform configurations of the same character as ribs 78*a*-78*g*. Reference characters 96 and 98 in FIG. 3 identify a convex protrusion and a concave scallop 98 of end member head 90, and reference characters 100 and 102, respectively identify a protrusion and a scallop of elastomeric component end member 87. However, in other applications of the invention, either or both of the end members 87 and 88 may have a different irregular profile configuration; and the cross-sectional configuration of the end member(s) may not be symmetrical.

Each of the B/D bow accessory ribs 78*a*-78*g*, the head 90 of mushroom-shaped end member 88, and the frustoconical end member head has four quadrants, each having a protrusion 93*a*-93*d* as an active element. The quadrants of one rib are identified in FIG. 6 by reference characters 104*a*-104*d*; and exemplary quadrants of head 90 and end member 87 are identified in FIGS. 3 and 4 respectively by reference characters 106 and 108.

Each of the rib quadrants and the mushroom-shaped and frustoconical end members can wiggle and jiggle independently. Each rib quadrant, the frustoconical end member, and the head and stem of the mushroom-shaped end member can therefore independently dampen vibration energies in multiple, different (though perhaps overlapping) sets of vibrational frequencies and amplitudes; and the effects of these independent actions are cumulative. The result of this multimode method of operation is that vibrations, are dampened at a significantly higher rate than has heretofore been achieved, resulting in a quieter shot, a smoother feel, significantly reduced movement of the bow when an arrow is shot and during and after lock-up, and an all-around better experience for the shooter because, as suggested above, the foregoing elements have maximum vibration dampening efficiencies with respect to different ones of the vibrational frequency sets in a spectrum of frequencies generated when an arrow is shot.

Vibration dampening efficiency is further promoted by optimizing the hardness of the elastomeric material from which the elastomeric component 66 of B/D accessory 46 is fabricated. Appropriate materials are those in the Sims Vibration Laboratory NAVCOM® family of elastomers. Optimum hardnesses are those in the Durometer A range of 7-40 Elastomeric B/D accessory components as disclosed herein are made from NAVCOM® materials having a hardness in the 12 to 20 Durometer range.

Figure 1:
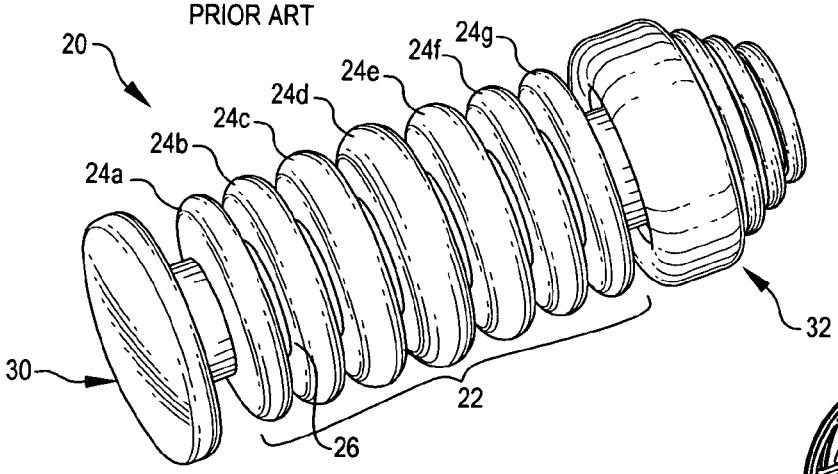
FIG. 1 PRIOR ART
FIG. 1 is a perspective view of a prior art archery bow stabilizer.

A B/D bow accessory such as the one discussed above and illustrated in FIGS. 2-7 has, in this regard, been found more effective in mitigating the effects of shock, vibration, and sound energies than the prior art bow stabilizer 20 illustrated in FIG. 1, the prior art bow stabilizers disclosed in the above-cited '307 patent, and the stabilizer disclosed in the above-cited Cabela's and Keystone Country Store websites.

The principles of the present invention may be embodied in forms other than the one specifically disclosed herein. A number of alternate forms are identified above. As further examples, for optimum efficiency in a particular application of the invention it is not necessary and may even be preferred that the ribs or comparable elements of the B/D device have an asymmetrical configuration rather than the symmetric configuration described above. Ribs or comparable elements of B/D devices optimized for particular applications of the invention may not be arranged in mirror image sets as in the embodiment of the invention disclosed herein or have the pattern of increasing thicknesses or generally uniform spacing of the ribs also disclosed herein, and a different method of supporting the ribs or the like from the rigid member of the device may be employed as may any of the alternate features identified above in this specification and still other features within the purview of the present invention. Therefore, the present embodiment is to be considered in all respects illustrative and not restrictive, the scope of the invention being indicated by the appended claims rather than by the foregoing description; and all changes which come within the meaning and range of equivalency of the claims are therefore intended to be embraced therein.

The invention claimed is:

1. An archery bow balancing and vibration dampening device which comprises:

a single, elongated, solid, rigid support; and an elastomeric, vibration dampening component mounted on the support;

the support extending through and from end-to-end of the elastomeric component; and the elastomeric component comprising:

a set of annular, outwardly extending vibration dampening elements, the dampening elements including an inner region of dampening elements and an outer region of dampening elements in the elastomeric component, all mounted on and spaced at intervals along the support and dampening elements within the set having variable dimensions relative to one another and dissimilar profiles; and stems between and separating the vibration dampening elements;

each vibration dampening element having a margin-defining peripheral edge with a head-on profile defined in part by cutouts which extend toward an axial centerline of the rigid support and which cutouts have variable heights relative to the axial centerline; and further wherein dampening elements within the inner region are stiffer than the dampening elements within the outer region and dampen vibrations of a higher frequency than dampening elements of the outer region.

2. A device as defined in claim 1:

which has first and second, integral end pieces at opposite ends of the set of vibration dampening elements;

wherein the first end piece has a monolithic, frustoconical configuration;

wherein the second end piece comprises a head and an integral stem extending from the head to the nearest one of the vibration dampening elements; and wherein there are axially extending cutouts in the first end piece and the head of the second end piece, those cutouts being axially aligned with the cutouts in the vibration dampening elements and the cutouts in the head of the second end piece being congruent with the cutouts in the vibration dampening elements.

3. The combination of an archery bow and a bow balancing and vibration dampening device as defined in claim 1:

the bow having a riser;

the bow balancing and vibration dampening device being attached to and extending away from the riser; and the bow balancing and dampening device being located substantially in its entirety exteriorly of the riser.

4. A combination as defined in claim 3 in which the support of the dampening device has device-to-riser attaching threads at an end thereof adjoining the riser.

5. A combination as defined in claim 3 and further wherein the margin-defining peripheral edge with a head-on profile defined in part by cutouts which extend toward an axial centerline of the rigid support and which have variable heights cutout heights from the axial centerline.

* * * * *